United States Patent [19]

Mieno et al.

[11] Patent Number: 4,763,628

[45] Date of Patent: Aug. 16, 1988

[54] METHOD OF COMPENSATING OUTPUT FROM OXYGEN CONCENTRATION SENSOR OF INTERNAL COMBUSTION ENGINE

[75] Inventors: Toshiyuki Mieno; Toyohei Nakajima; Yasushi Okada; Nobuyuki Oono, all of Wako, Japan

[73] Assignee: Honda Giken Kogyo Kabushiki Kaisha, Tokyo, Japan

[21] Appl. No.: 21,035

[22] Filed: Mar. 2, 1987

[30] Foreign Application Priority Data

Mar. 3, 1986 [JP] Japan ..... 61-46967

[51] Int. Cl.[4] ..... F02B 3/00

[52] U.S. Cl. ..... 123/440; 123/491; 123/488

[58] Field of Search ..... 123/491, 489, 440, 488

[56] References Cited

U.S. PATENT DOCUMENTS

| | | | |
|---|---|---|---|
| 4,357,922 | 11/1982 | Rosenzopf | 123/491 |
| 4,566,419 | 1/1986 | Ninomiya | 123/440 |
| 4,580,539 | 4/1986 | Kitahara | 123/440 |

*Primary Examiner*—Ronald B. Cox

*Attorney, Agent, or Firm*—Pollock, Vande Sande and Priddy

[57] ABSTRACT

Compensation of an output from an oxygen concentration sensor of an air/fuel ratio control apparatus for an internal combustion engine is executed during engine warm-up, to correct for an erroneous component in the oxygen concentration sensor output data caused by incomplete combustion during warm-up. The degree of compensation applied is determined by the engine operating temperature, as represented by the cooling water temperature. Excessive richness of the air/fuel ratio of the mixture supplied to the engine during warm-up is thereby eliminated.

2 Claims, 5 Drawing Sheets

METHOD OF COMPENSATING OUTPUT FROM OXYGEN CONCENTRATION SENSOR OF INTERNAL COMBUSTION ENGINE

BACKGROUND OF THE INVENTION

1. Field of the Invention

The present invention relates to a method of compensating the level of an output signal from an oxygen concentration sensor of an internal combustion engine.

2. Description of Related Art

In order to reduce exhaust gas pollutants and to improve the fuel consumption of an internal combustion engine, it is now common practice to employ an oxygen concentration sensor to detect the concentration of oxygen in the engine exhaust gas, and to execute feedback control of the air-fuel ratio of the mixture supplied to the engine such as to maintain the air/fuel ratio at a target value. This feedback control is performed in accordance with an output signal from the oxygen concentration sensor.

One form of oxygen concentration sensor which can be employed for such air/fuel ratio control functions by producing an output signal which varies in level in proportion to the oxygen concentration in the engine exhaust gas. Such an oxygen concentration sensor has been disclosed for example in Japanese patent laid-open No. 52-72286. This sensor consists of an oxygen ion-conductive solid electrolytic member formed as a flat plate having electrodes formed on two main faces, with one of these electrode faces forming part of a gas sampling chamber. The gas sampling chamber communicates with a gas which is to be measured, i.e. exhaust gas, through a lead-in aperture. With such an oxygen concentration sensor, the oxygen ion-conductive solid electrolytic member and its electrodes function as an oxygen pump element. By passing a flow of current between the electrodes such that the electrode within the gas sampling chamber becomes a negative electrode, oxygen gas within the gas sampling chamber adjacent to this negative electrode becomes ionized, and flows through the solid electrolytic member towards the positive electrode, to be thereby emitted from that face of the sensor element as gaseous oxygen. The current which flows between the electrodes is a boundary current value which is substantially constant, i.e. is substantially unaffected by variations in the applied voltage, and is proportional to the oxygen concentration within the gas under measurement. Thus, by sensing the level of this boundary current, it is possible to measure the oxygen concentration within the gas which is under measurement. However if such an oxygen concentration sensing apparatus is used to control the air/fuel ratio of the mixture supplied to an internal combustion engine, by measuring the oxygen concentration within the engine exhaust gas, it will only be possible to control the air/fuel ratio to a value which is in the lean region, relative to the stoichiometric air/fuel ratio. It is not possible to perform air/fuel ratio control to maintain a target air/fuel ratio which is set in the rich region.

An oxygen concentration sensor which will provide an output signal level varying in proportion to the oxygen concentration in engine exhaust gas for both the lean region and the rich region of the air/fuel ratio has been proposed in Japanese patent laid-open No. 59-192955. This sensor consists of two oxygen ion-conductive solid electrolytic members each formed as a flat plate, and each provided with electrodes. Two opposing electrode faces, i.e. one face of each of the solid electrolytic members, form part of a gas holding chamber which communicates with and retains a gas under measurement, via a lead-in aperture. The other electrode of one of the solid electrolytic members faces into the atmosphere. In this oxygen concentration sensor, one of the solid electrolytic members and its electrodes functions as an oxygen concentration ratio sensor cell element. The other solid electrolytic member and its electrodes functions as an oxygen pump element. If the voltage which is generated between the electrodes of the oxygen concentration ratio sensor cell element is higher than a reference voltage value, then current is supplied between the electrodes of the oxygen pump element such that oxygen ions flow through the oxygen pump element towards the electrode of that element which is within the gas sampling chamber. If the voltage developed between the electrodes of the sensor cell element is lower than the reference voltage value, then a current is supplied between the electrodes of the oxygen pump element such that oxygen ions flow through that element towards the oxygen pump element electrode which is on the opposite side to the gas holding chamber. In this way, a value of current is obtained which varies in proportion to the oxygen concentration of the gas under measurement, both in the rich and the lean regions of the air/fuel ratio.

However if air/fuel ratio control is executed by using such an oxygen concentration sensor, producing an output varying in proportion to oxygen concentration, then if air/fuel ratio control is initiated after completion of activation of the oxygen concentration sensor during a period of warming-up operation of the engine, the gas which is passed to the sensor will have been produced with incomplete combustion taking place in the engine, so that the output from the sensor will contain a component which results from this incomplete combustion. FIG. 1 is a graph for comparing operation during the warm-up period and operation after warm-up has been completed. As shown, during the warm-up period, the level of pump current which is the output value from the oxygen concentration sensor (and which represents the air/fuel ratio of the mixture supplied to the engine) is higher than the value which is obtained during operation after warm-up has been completed. As a result, problems arise since it is not possible to accurately judge the air/fuel ratio of the mixture which is being supplied to the engine on the basis of the output signal level from the oxygen concentration sensor.

SUMMARY OF THE INVENTION

It is an objective of the present invention to provide a method of compensating an output from an oxygen concentration sensor such as to enable the air/fuel ratio of a mixture supplied to an engine to be accurately judged, based upon an output signal level from the oxygen concentration sensor, during engine warm-up operation.

According to the present invention, there is provided:

a method of compensating a level of an output signal from an oxygen concentration sensor which is disposed within an exhaust system of an internal combustion engine for producing an output signal varying in proportion to a concentration of oxygen in exhaust gas from said engine, the method comprising sensing an operating temperature of said engine and executing compensation of said oxygen concentration sensor output signal in accordance with a result of said temperature sensing.

DETAILED DESCRIPTION OF EMBODIMENTS

Figure 1:
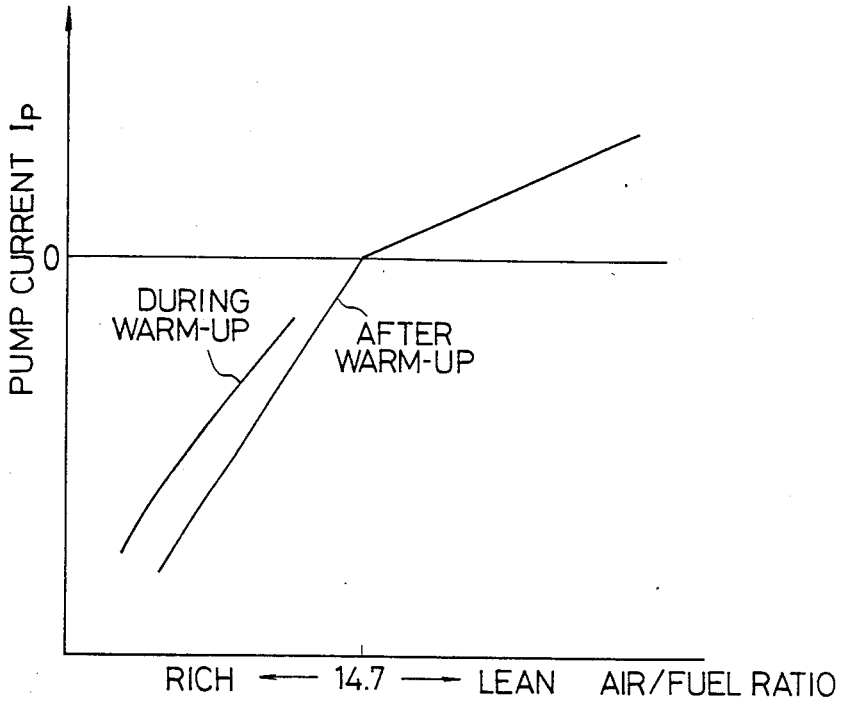
FIG. 1 a graph to illustrate the output characteristic of an oxygen concentration sensor during warm-up operation and during operation after completion of warm-up.
Figure 2:
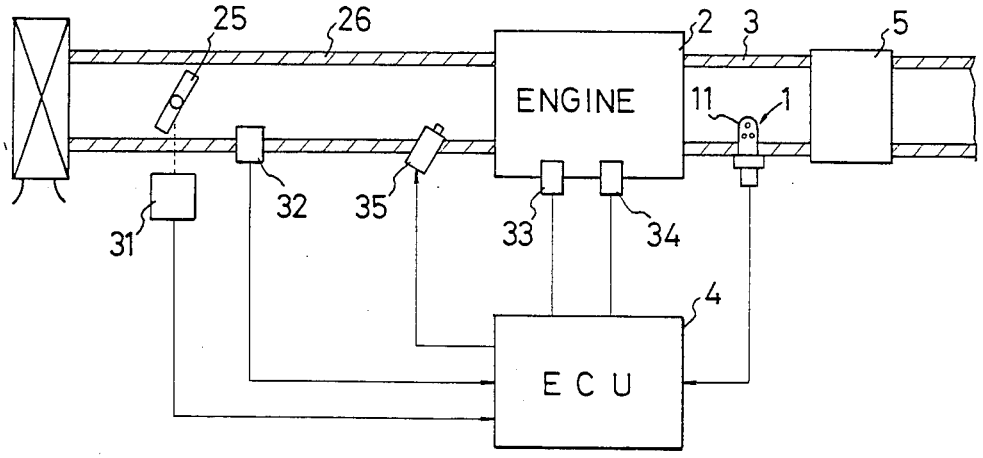
FIG. 2 is a diagram of an electronic fuel injection control apparatus including an oxygen concentration sensor to which the compensation method of the present invention is applied.
Figure 3:
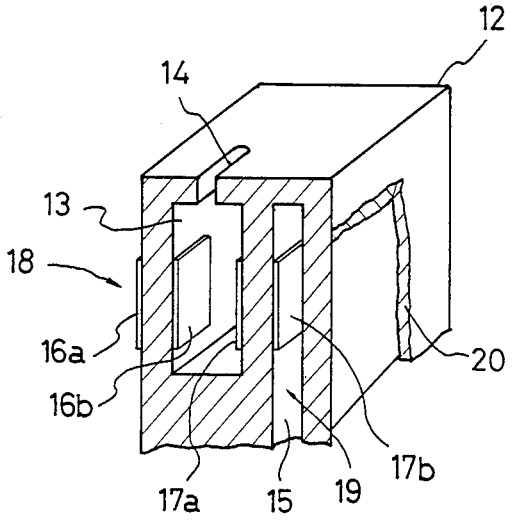
FIG. 3 is a diagram showing the internal configuration of an oxygen concentration sensor detection unit.
Figure 4:
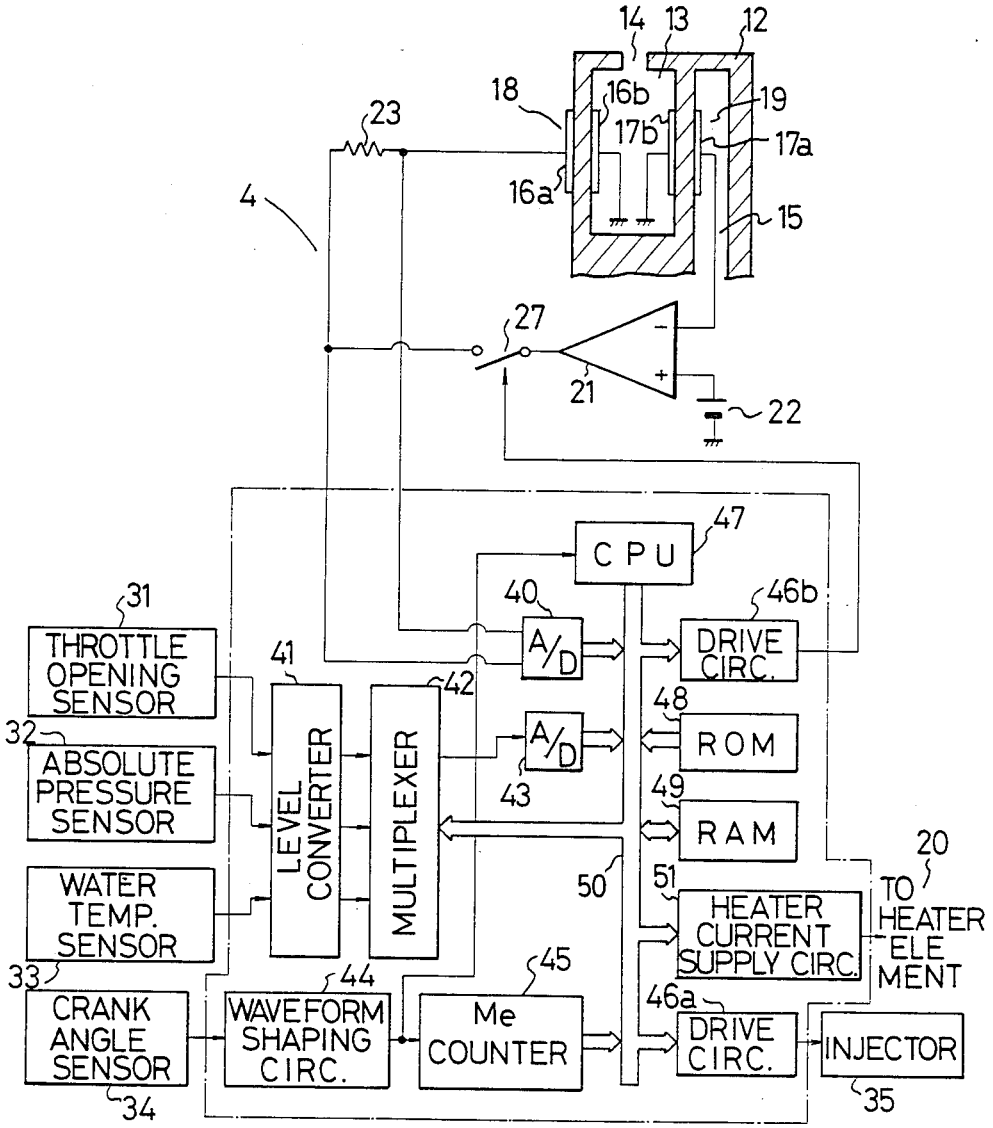
FIG. 4 is a general block circuit diagram of the electronic control unit (ECU) in the apparatus of FIG. 2.

An embodiment of the present invention will now be described, referring to the drawings. FIGS. 2 through 4 show an electronic fuel control apparatus for an internal combustion engine incorporating an oxygen concentration sensor which utilizes the output compensation method of the present invention. In this apparatus, an oxygen concentration sensor detection unit 1 is mounted within an exhaust pipe 3 of an engine 2, upstream from a catalytic converter 5. Inputs and outputs of the oxygen concentration sensor detection unit 1 are coupled to an ECU (electronic control unit) 4.

The protective case 11 of the oxygen concentration sensor detection unit contains an oxygen ion-conductive solid electrolytic member 12 having a substantially rectangular shape, of the form shown in FIG. 3. A gas sampling chamber 13 is formed in the interior of the solid electrolytic member 12, and communicates via a lead-in aperture 14 with an exhaust gas at the exterior of solid electrolytic member 12, constituting a gas to be sampled. The lead-in aperture 14 is positioned such that the exhaust gas will readily flow from the interior of the exhaust pipe 3 into the gas sampling chamber 13. In addition, an atmospheric reference chamber 15 is formed within the solid electrolytic member 12, into which atmospheric air is led. The atmospheric reference chamber 15 is separated from the gas sampling chamber 13 by a partition. As shown, pairs of electrodes 17*a*, 17*b* and 16*a*, 16*b* are respectively formed on the partition, between chambers 13 and 15 and on the wall of chamber 13 remote from chamber 15. The solid electrolytic member 12 functions in conjunction with the electrodes 16*a* and 16*b* as an oxygen pump element 18, and functions in conjunction with electrodes 17*a*, 17*b* as a sensor cell element 19. A heater element 20 is mounted on the external surface of the atmospheric reference chamber 15.

The oxygen ion-conductive solid electrolytic member 12 is formed of $ZrO_2$ (zirconium dioxide), while the electrodes 16*a* through 17*b* are each formed of platinum.

As shown in FIG. 4, the ECU 4 includes a circuit consisting of a differential amplifier 21, a reference voltage source 22, a current sensing resistor 23 and a switch 27, which in combination constitute an oxygen concentration sensor control section. The electrode 16*b* of the oxygen pump element 18 and electrode 17*b* of the sensor cell element 19 are each connected to ground potential. Electrode 17*a* of the sensor cell element 19 is connected to an inverting input terminal of differential amplifier 21, which produces an output voltage in accordance with the voltage difference between a voltage developed across electrodes 17*a* and 17*b* of the sensor cell element 19 and the output voltage from the reference voltage source 22. The output voltage from reference voltage source 22 is a value corresponding to a stoichiometric air/fuel ratio (for example 0.4 V). The output terminal of differential amplifier 21 is connected through switch 27 and the current sensing resistor 23 to electrode 16*a* of the oxygen pump element 18. The terminals of current sensing resistor 23 constitute a pair of output terminals of the oxygen concentration sensor, and are coupled to a microcomputer which constitutes the control circuit 24.

The control circuit 24 is respectively connected to a throttle valve opening sensor 31 which produces an output voltage in accordance with the degree of opening of throttle valve 25, and which consists of a potentiometer. Control circuit 24 is further connected to an absolute pressure sensor 32 which is mounted in intake pipe 26 at a position downstream from the throttle valve 25 and which produces an output voltage varying in level in accordance with the absolute pressure within the intake pipe 26. Control circuit 24 is also connected to a water temperature sensor 33 which produces an output voltage varying in level in accordance with the temperature of the engine cooling water, and to a crankshaft angle sensor 34 which produces a signal consisting of successive pulses respectively produce in synchronism with rotation of the crankshaft (not shown in the drawings) of engine 2. Control circuit 24 is also connected to an injector 35, provided in the intake pipe 26, near the intake valves (not shown in the drawings) of engine 2.

The control circuit 24 includes an A/D converter (analog/digital converter) 40 which converts the voltage developed between the terminals of the current sensing resistor 23 into a digital signal, and a level converter circuit 41 which performs level conversion of each of the output signals from the throttle valve opening sensor 31, absolute pressure sensor 32 and water temperature sensor 33. The resultant level-converted signals from level converter circuit 41 are supplied to inputs of a multiplexer 42. Control circuit 24 also includes an A/D converter 43 which converts the output signals from multiplexer 42 to digital form, a waveform shaping circuit 44 which executes waveform shaping of the output signal from the crankshaft angle sensor 34 to produce TDC (top dead center) signal pulses as output, and a counter 45 which counts a number of clock pulses (produced from a clock pulse generating circuit which is not shown in the drawings) during each interval between successive TDC pulses from the waveform shaping circuit 44. Control circuit 24 further includes a drive circuit 46*a* for driving the injector 35, an "ON" drive circuit 46*b* for driving switch 27 to the ON state, a CPU (central processing unit) 47 for performing digital computation in accordance with a program, a ROM (read-only memory) 48 having various processing programs and data stored therein, and a RAM (random access memory) 49. The A/D converters 40 and 43, multiplexer 42, counter 45, drive circuits 46*a*, 46*b*, CPU 47, ROM 4S and RAM 49 are mutually interconnected by an input/output bus 50. The TDC signal is supplied from the waveform shaping circuit 44 to the CPU 47. The control circuit 24 also includes a heater current supply circuit 51, which supplies current to the heater element 20 in accordance with heater current supply commands from CPU 47, to implement heating by heater element 20.

Data representing a pump current value $I_P$ corresponding to the current flow through the oxygen pump element 18, transferred from A/D converter 40, data representing a degree of throttle valve opening $\theta_{th}$ from A/D converter 43, data representing the absolute pressure $P_{AB}$ within the intake pipe, and data representing the cooling water temperature $T_W$ are respectively selectively supplied to CPU 47 over the I/O bus 50. In addition, data representing the engine speed of rotation $N_E$, from counter 45, is also supplied to CPU 47 over I/O bus 50. The CPU 47 executes read-in of each of these data in accordance with a processing program which is stored in the ROM 48, and computes a fuel injection time interval $T_{OUT}$ for injector 35 on the basis of the data, in accordance with a fuel injection quantity for engine 2 which is determined from predetermined equations. This computation is performed by means of a fuel supply routine, which is executed in synchronism with the TDC signal. The injector 35 is then actuated by drive circuit 46a for the duration of the fuel injection time interval $T_{OUT}$, to supply fuel to the engine.

The fuel injection time interval $T_{OUT}$ can be obtained for example from the following equation:

$$T_{OUT}=T_I\times K_{O2}\times K_{WOT}\times K_{TW} \quad (1)$$

In the above equation, $T_I$ is the basic supply quantity, which is determined in accordance with the engine speed of rotation $N_E$ and the absolute pressure $P_{AB}$ in the intake pipe and which expresses a basic injection time interval. $K_{O2}$ is a feedback compensation coefficient for the air/fuel ratio, which is set in accordance with the output signal level from the oxygen concentration sensor. $K_{WOT}$ is a fuel quantity increment compensation coefficient, which is applied when the engine is operating under high load. $K_{TW}$ is a cooling water temperature coefficient. $T_I$, $K_{O2}$, $K_{WO2}$ and $K_{TW}$ are respectively set by a subroutine of the fuel supply routine.

The "ON" drive circuit 46b drives switch 27 to the ON state in response to an ON drive command from CPU 47, and also halts this driving of switch 27 to the ON state in response to an ON drive halt command from CPU 47. When switch 27 is driven to the ON state, a flow of pump current is initiated between the electrodes 16a and 16b of the oxygen pump element 18, with this current flowing from the output terminal of differential amplifier 21 through switch 27 and resistor 23.

When the supply of pump current to the oxygen pump element begins, if the air/fuel ratio of the mixture which is supplied to engine 2 at that time is in the lean region, then the voltage which is produced between electrodes 17a and 17b of the sensor cell element 19 will be lower than the output voltage from the reference voltage source 22, and as a result the output voltage level from the differential amplifier 21 will be positive. This positive voltage is applied through the series-connected combination of resistor 23 and oxygen pump element 18. A pump current thereby flows from electrode 16a to electrode 16b of the oxygen pump element 18, so that the oxygen within the gas sampling chamber 13 becomes ionized by electrode 16b, and flows through the interior of oxygen pump element 18 from electrode 16b, to be ejected from electrode 16a as gaseous oxygen. Oxygen is thereby drawn out of the interior of the gas sampling chamber 13.

As a result of this withdrawal of oxygen from the gas sampling chamber 13, a difference in oxygen concentration will arise between the exhaust gas within gas sampling chamber 13 and the atmospheric air within the atmospheric reference chamber 15. A voltage $V_S$ is thereby produced between electrodes 17a and 17b of the sensor cell element 19 at a level determined by this difference in oxygen concentration, and the voltage $V_S$ is applied to the inverting input terminal of differential amplifier 21. The output voltage from differential amplifier 21 is proportional to the voltage difference between the voltage $V_S$ and the voltage produced from reference voltage source 22, and hence the pump current is proportional to the oxygen concentration within the exhaust gas. The pump current value is output as a value of voltage appearing between the terminals of current sensing resistor 23.

When the air/fuel ratio is within the rich region, the voltage $V_S$ will be higher than the output voltage from reference voltage source 22, and hence the output voltage from differential amplifier 21 will be inverted from the positive to the negative level. In response to this negative level of output voltage, the pump current which flows between electrodes 16a and 16b of the oxygen pump element 18 is reduced, and the direction of current flow is reversed. Thus, since the direction of flow of the pump current is now from the electrode 16b to electrode 16a, oxygen will be ionized by electrode 16a, so that oxygen will be transferred as ions through oxygen pump element 18 to electrode 16b, to be emitted as gaseous oxygen within the gas sampling chamber 13. In this way, oxygen is drawn into gas sampling chamber 13. The supply of pump current is thereby controlled such as to maintain the oxygen concentration within the gas sampling chamber 13 at a constant value, by drawing oxygen into or out of chamber 13, so that the pump current $I_P$ and the output voltage from differential amplifier 21 will always be respectively proportional to the oxygen concentration in the exhaust gas, both for operation in the lean region and in the rich region of the air/fuel ratio. The value of the feedback compensation coefficient $K_{O2}$ referred to above is established in accordance with the pump current value $I_P$.

Figure 5:
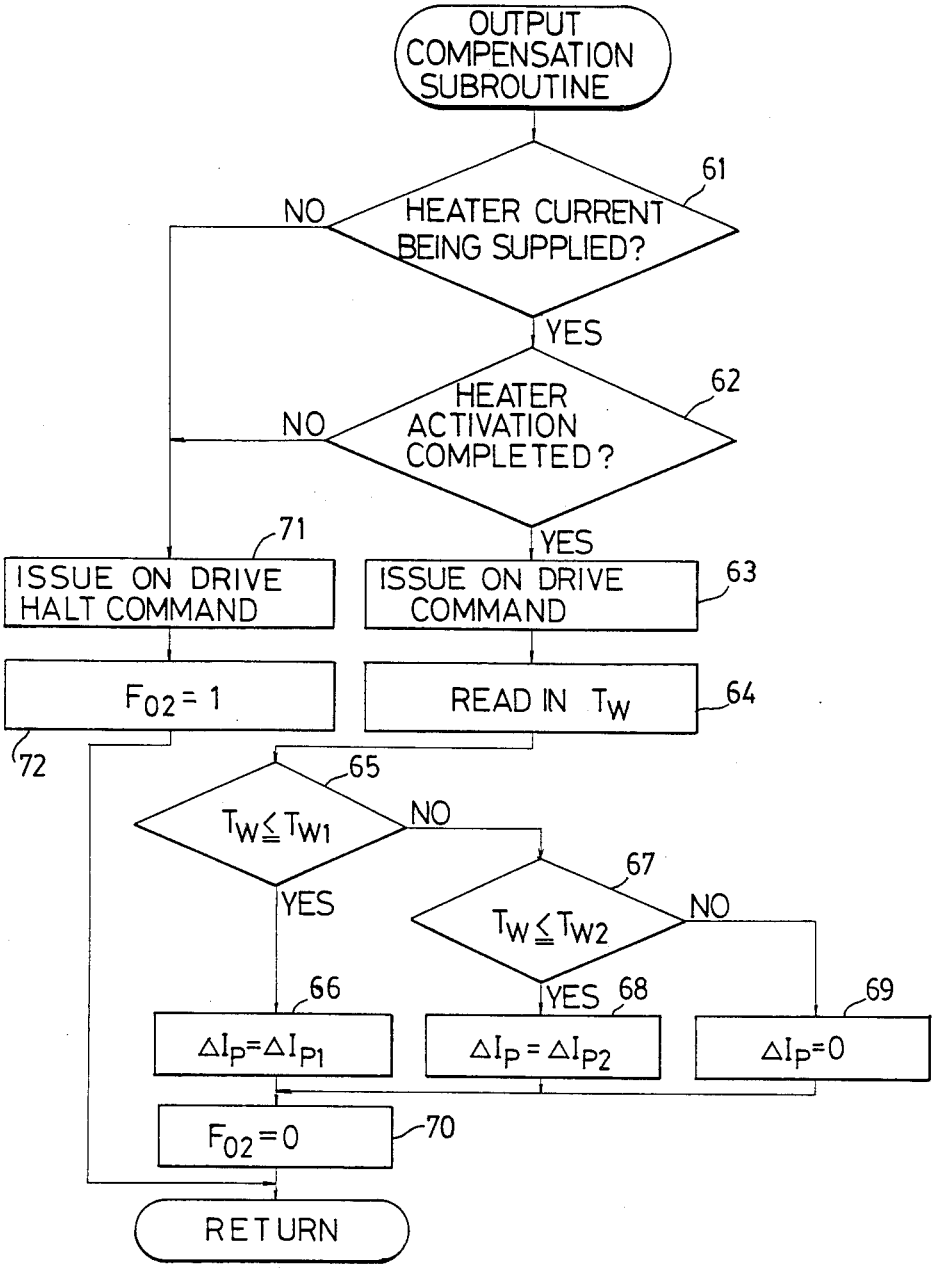
FIGS. 5 and 6 are flow diagrams to illustrate the operation of the ECU of FIG. 4.

An example of an operating sequence of the method according to the present invention for compensation of the output from an oxygen concentration sensor will be described referring first to FIG. 5, which is a flow diagram of an output compensation subroutine that is executed by CPU 47.

At the start of this operating sequence, CPU 47 first judges whether or not heater current is being supplied to the heater element 20 (step 61). This decision is made based upon the status of a flag $F_H$ in CPU 47. If a heater current supply command has been issued for heater current supply circuit 51, then flag $F_H$ is set to the "1" state, while if a heater current supply halt command has been issued, then flag $F_H$ is set to the "0" state. If it is found in step 61 that heater current is being supplied, then a decision is made as to whether or not activation of the oxygen concentration sensor has been completed (step 62). This decision is made by detecting whether or not a predetermined time interval has elapsed since the supply of heater current was initiated, i.e. since a heater current supply command was issued. If activation of the oxygen concentration sensor has been completed, then a "drive ON" command is issued to drive circuit 46b, in order to supply pump current to the oxygen pump element 18 (step 63). The cooling water temperature $T_W$ is then read in (step 64), and a decision is made as to whether or not the cooling water temperature $T_W$ is lower than a predetermined temperature $T_{W1}$, e.g. O° C. (step 65). If $T_W$ is less than or equal to $T_{W1}$, then a compensation value $\Delta I_P$ is made equal to a first predetermined value $\Delta I_{P1}$ (step 66). If $T_W$ is greater than $T_{W1}$, then a decision is made as to whether or not the cooling water temperature $T_W$ is less than or equal to a predetermined temperature $T_{W2}$ (where $T_{W2} > T_{W1}$, e.g. where $T_{W2} = 40°$ C.) (step 67). If $T_W$ is less than or equal to $T_{W2}$, then the compensation value $\Delta I_P$ is made equal to a second predetermined value $\Delta I_{P2}$ (step 68). If $T_W$ is greater than $T_{W2}$, then the compensation value $\Delta I_P$ is made equal to 0 (step 69), and a flag $F_{O2}$ is set to the "0" state (step 70).

If it is found in step 61 that heater current is not being supplied, or if it is found in step 62 that activation of the oxygen concentration sensor detection unit 1 has not yet been completed, then a "drive ON halt" command is issued to drive circuit 46b, to halt the supply of pump current to the oxygen pump element 18 (step 71). A flag $F_{O2}$ is is then set to the "1" state, to indicate that the system is not in a suitable operating condition for executing air/fuel ratio control (step 72).

Execution of the subroutine described above begins simultaneously with starting of the engine by means of the fuel supply routine, and is performed in synchronism with the TDC signal. It is preferable to arrange that the subroutine is not executed if the correction value $\Delta I_P$ becomes equal to zero.

Figure 6:
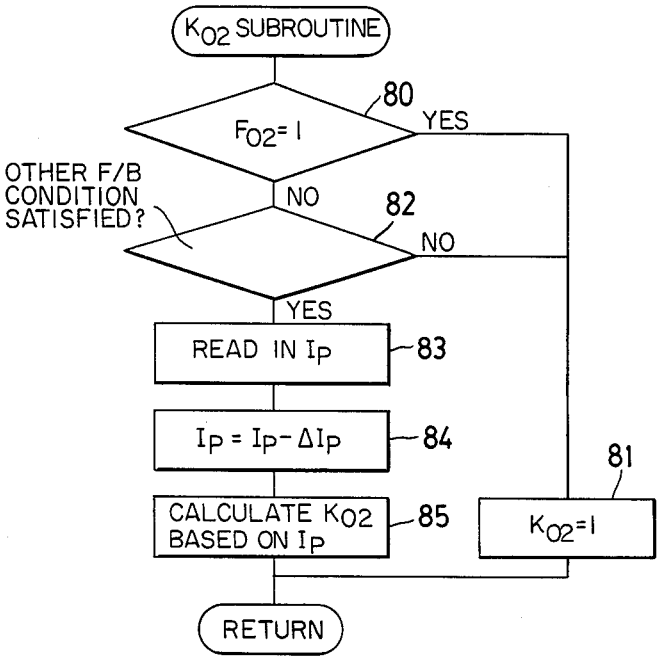

FIG. 6 shows a $K_{O2}$ subroutine whereby the value of the feedback compensation coefficient $K_{O2}$ is established. Firstly, a decision is made as to whether or not flag $F_{O2}$ is set to the "1" state (step 80). If $F_{O2}$ is "1", then this indicates that the system operating condition is such that air/fuel ratio feedback control should be halted, and so the compensation coefficient $K_{O2}$ is made equal to 1 (step 81). If flag $F_{O2}$ is not set to the "1" state, then a decision is made as to whether or not other operating conditions for suitability of applying air/fuel ratio feedback control are satisfied (step 82). This decision is made on the basis of the throttle valve degree of opening $\phi_{TH}$, the engine cooling water temperature $T_W$, the engine speed of rotation $N_E$, and the absolute pressure in the intake pipe $P_{AB}$. For example, acceleration and deceleration are operating conditions in which air/fuel ratio feedback control should be halted. In such a case, the compensation coefficient $K_{O2}$ is made equal to 1 (step 81). If the operating conditions for suitability of applying air/fuel ratio feedback control are satisfied, then the pump current value $I_P$ is read in (step 83). The compensation value $\Delta I_P$ is then subtracted from the pump current value $I_P$ that has been read in, and the result is made the new pump current value $I_P$ (step 84). The feedback compensation coefficient $K_{O2}$ is then computed, in accordance with the corrected pump current value $I_P$ derived in step 84 (step 85). Equation (1) is then utilized to compute the fuel injection time interval $T_{OUT}$, employing the corrected pump current value $I_P$.

With an oxygen concentration sensor output compensation method according to the present invention, the lower the engine cooling water temperature $T_W$ during the engine warm-up period, the greater is made the compensation value $\Delta I_P$, and this compensation value $\Delta I_P$ is subtracted from the pump current value $I_P$ to perform compensation of $I_P$. Thus, the lower the temperature of the engine cooling water, the greater will be the degree of compensation which is applied to the pump current value $I_P$ in the direction of increased mixture richness.

Figure 7:
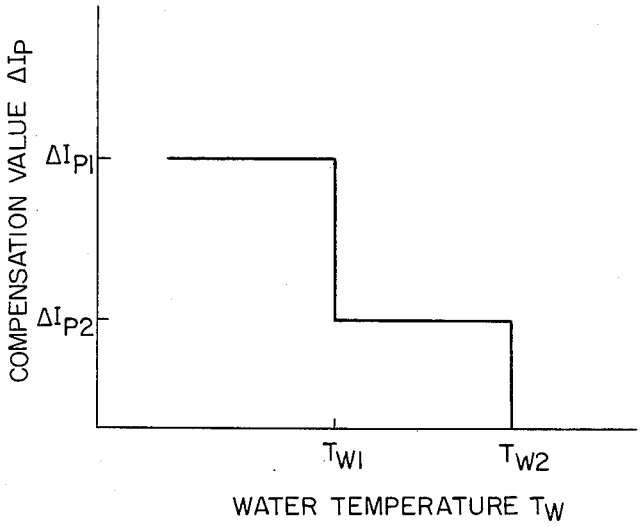
FIG. 7. is a graph showing the relationship between engine cooling water temperature $T_W$ and a compensation value $I_P$.

In the embodiment of the invention described above, the compensation value $\Delta I_P$ of the pump current value $I_P$ is established in a stepwise manner in accordance with the engine cooling water temperature $T_W$, as shown in FIG. 7. However it would be equally possible to set the compensation value $\Delta I_P$ in accordance with $T_W$ in a continuously varying manner.

Furthermore, in the embodiment of the invention described above, the air/fuel ratio of the mixture supplied to the engine is controlled to a target air/fuel ratio, by adjusting the fuel supply quantity in accordance with the pump current value $I_P$. However it should be noted that the invention is not limited to such adjustment, and that it would be equally possible to control the air/fuel ratio to attain a target value of air/fuel ratio by adjusting a secondary air intake quantity in accordance with the pump current value $I_P$.

As described in the above, a method according to the present invention for compensating the output from an oxygen concentration sensor is characterized in compensating the output signal level from the oxygen concentration sensor in accordance with engine temperature, whereby the air/fuel ratio of the mixture supplied to the engine can be accurately controlled even when the oxygen concentration sensor output data includes a component representing oxygen in the exhaust gas which results from incomplete combustion. The invention therefore enables the air/fuel ratio of the mixture supplied to the engine to be accurately controlled to a target value during the engine warm-up period, to thereby lower the emission of pollutants in the exhaust gas during warm-up operation. In addition, the method of the present invention enables excessive mixture richness during warm-up operation to be avoided, thereby preventing the deposition of carbon on the spark plugs and resultant deterioration of engine performance.

What is claimed is:

1. A method of compensating the level of an output signal from an oxygen concentration sensor which comprises a portion of an internal combustion engine air/fuel ratio control system, said oxygen concentration sensor being disposed within the exhaust system of the internal combustion engine for producing an output signal varying in proportion to the concentration of oxygen in exhaust gas from said engine, the method comprising the steps of sensing an operating temperature of said engine, executing compensation of a level of said oxygen concentration sensor output signal in accordance with a result of said temperature sensing step, and utilizing the output level produced by said compensating step as the detected value of oxygen concentration that is employed in controlling the air/fuel ratio of the mixture to be supplied to said engine.

2. A compensation method according to claim 1, in which said oxygen concentration sensor output signal level is compensated such as to produce increasing degrees of richness of the air/fuel mixture supplied to said engine as the values of said operating temperature decrease.

* * * * *